United States Patent [19]

Yamamura

[11] 4,188,558

[45] Feb. 12, 1980

[54] X-RAY TUBE

[75] Inventor: Toshio Yamamura, Yokohama, Japan

[73] Assignee: Tokyo Shibaura Electric Co., Ltd., Tokyo, Japan

[21] Appl. No.: 913,208

[22] Filed: Jun. 6, 1978

[30] Foreign Application Priority Data

Jun. 11, 1977 [JP] Japan ..... 52-69275

[51] Int. Cl.[2] ..... H01J 35/16

[52] U.S. Cl. ..... 313/55; 313/148

[58] Field of Search ..... 313/55, 148, 177

[56] References Cited

U.S. PATENT DOCUMENTS 2,424,457 7/1947 Haynes et al. ..... 313/177

2,839,701 6/1958 Bourns ..... 313/148 X 3,560,789 2/1971 Hernqvist et al. ..... 313/177

FOREIGN PATENT DOCUMENTS 303339 8/1968 Sweden ..... 313/55

*Primary Examiner*—Palmer C. Demeo

*Attorney, Agent, or Firm*—Cushman, Darby & Cushman

[57] ABSTRACT

An X-ray tube, which comprises an opening bored in a prescribed position in the envelope of the X-ray tube, and means for reducing the internal pressure of the X-ray tube, when said internal pressure gets higher beyond a prescribed extent than external pressure, thereby enabling the X-ray tube to be safely removed from an X-ray housing.

15 Claims, 7 Drawing Figures

X-RAY TUBE

This invention relates to an X-ray tube used with a gas-insulated X-ray device. The known gas-insulated X-ray tube comprises, as shown in FIG. 1, an X-ray tube 2 received in a housing 1 resistant to electric shocks and capable of preventing the leakage of X-rays; an anode 5 and/or a cathode 6 on which high voltage is impressed through high voltage receptacles 3, 4 respectively; and a space 8 lying between the X-ray housing 1 and the envelope 7 of the X-ray tube 2, said region being filled with a medium, for example, insulating oil or gas for cooling and shutting off heat generated around the anode 5 and/or cathode 6.

With a medical high voltage X-ray tube apparatus or X-ray generator for diagnosis by X-ray penetration, a gas of, for example, sulphur hexafluoride ($SF_6$) which is lighter than insulating oil is applied as a medium for the above-mentioned cooling and insulation. Such kind of insulating gas does not sufficiently serve the purpose, unless introduced into the aforesaid sealing space 8 in a highly pressurized condition. Generally, therefore, an insulating gas having of a pressure of 3 to 5 kg/cm$^2$ is sealed in said space 8.

Where, with an X-ray device in which such high pressure insulating gas is sealed, pin holes arise perchance in the envelope 7 of the X-ray tube 2 made of glass or ceramic, then the high pressure insulating gas is carried through said pin holes into the evacuated X-ray tube 2. Eventually, the internal pressure of the X-ray tube 2 will become equal to that of the insulating gas sealed in the above-mentioned space 8. The X-ray tube 2 whose vacuum has thus been broken is taken out of the X-ray housing 1 as a disqualified unit. Since, however, the envelope of the X-ray tube 2 made of, for example, glass has a low resistance to the internal pressure thereof, there will probably arise the danger of the X-ray tube 2 being exploded while being removed from the housing or during storage.

It is accordingly the object of this invention to provide an X-ray tube which can be safely taken out of a housing without the possibility of, for example, explosion, when the internal pressure of the X-ray tube rises higher than the atmospheric pressure.

This invention can be more fully understood from the following detailed description when taken in conjunction with the accompanying drawings, in which.

Figure 1:
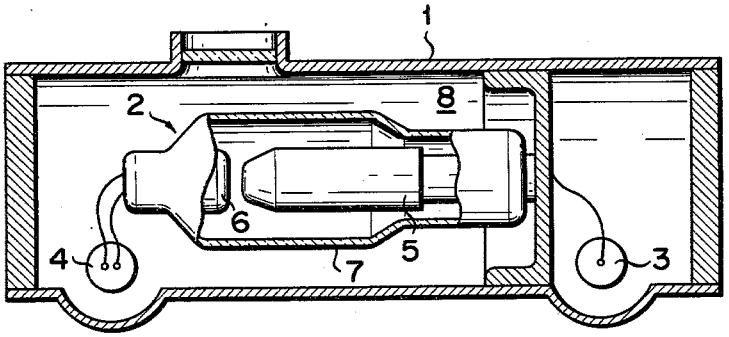
FIG. 1 (PRIOR ART)
FIG. 1 is a sectional view of a gas-insulated X-ray device using the prior art X-ray tube.
Figure 2:
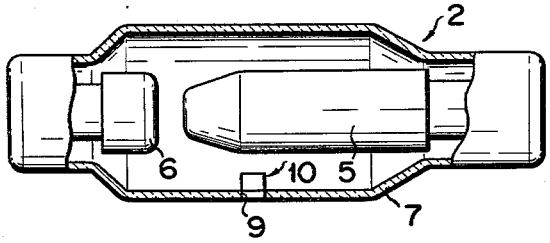
FIG. 2 is a sectional view of an X-ray tube embodying this invention.
Figure 3:
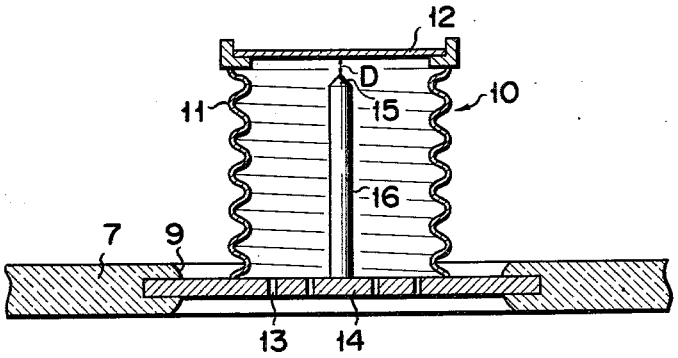
FIG. 3 is a sectional view of a pressure-reducing device fitted to the X-ray tube of FIG. 2.

An X-ray tube 2 embodying this invention comprises a pressure-reducing device 10 disposed at an opening 9 bored in the envelope 7 of the X-ray tube 2 to decrease the internal pressure of the X-ray tube 2 when it rises higher than the pressure beyond a prescribed extent. One embodiment of this pressure-reducing device 10 is shown in FIG. 3. This pressure-reducing device 10 comprises cylindrical elastic bellows 11 with 30 mm in outer diameter, 20 mm in inner diameter, and 0.15 mm thick and made of SUS 304 stainless steel; a shield 12 with 20 mm in diameter and 0.4 mm thick, made of annealed oxygen-free copper, mounted on upper part of the bellows 11, and vertically movable by pressure difference between inside and outside of the X-ray tube 2; and a metal plate 14 made of material having a thermal expansion coefficient approximating that of glass such as iron-nickel alloy marketed under the trademark "Kovar", bored with a plurality of random-arranged penetrating holes 13, and fixed to the envelope 7 of the X-ray tube 2 securely to hold the lower end of the bellows 11; and a rod 16 2 mm in diameter, made of alloy steel, provided with a sharpened end 15, and vertically extending from the center of the metal plate 14 toward the shield 12. A distance D between the underside of the shield 12 and the tip of the sharpened end 15 of the rod 16 is defined in consideration of the size and physical properties of the shield 12 and the anticipated internal pressure of the X-ray tube 2. Now let it be assumed that where the internal pressure of the X-ray tube 2 stands at 2 atm, it is desired to reduce said pressure by causing the sharpened end 15 of the rod 16 to penetrate the shield 12. Further, let it be supposed that the bellows 11 have an effective area of about 5.0 cm$^2$; the Young's modulus of the shield 12 indicates about $1\times10^6$ kgw/cm$^2$; and the tensile strength of said shield 12 is about 2000 kgw/cm$^2$. Then an amount of deflection of the shield 12 and a maximum stress applied to the tip of the sharpened end of the rod 16 are calculated to be 2.7 mm and 10,000 kgw/cm$^2$, respectively. If, therefore, the above-mentioned distance D is set at a smaller value than 2.7 mm or preferably at about 2 mm, then it will be seen that the sharpened end of the rod 16 can penetrate the shield 12, and a force about 5 times greater than the strength of the shield 12 which acts at this time fully breaks the shield 12.

The opening 9 should preferably be bored in that portion of the envelope 7 of the X-ray tube 2 which faces the stem of the anode 5 or cathode 6 or at the longitudinal center of said envelope. The pressure-reducing device 10 is provided at the opening 9.

There will now be described the operation of an X-ray tube 2 embodying this invention. The X-ray tube 2 is set in a prescribed position in the X-ray housing 1. Insulating gas is sealed at a pressure of 3 to 5 kg/cm$^2$ in a space 8 lying between the envelope 7 of the X-ray tube 2 and the X-ray housing 1. Since, at this time, the X-ray tube 2 remains evacuated, no pressure is applied to the pressure-reducing device 10 of this invention. Therefore, the shield 12 is kept apart from the sharpened end 15 of the rod 16. Should pinholes occur in the envelope 7 of the X-ray tube 2 during its operation, then the insulating gas will be carried into the X-ray tube 2 through the pinholes. As the result, the interior of the X-ray tube 2 will be shifted from an evacuated to a pressurized condition, until the internal pressure becomes equal to the pressure in the space 8 lying between the envelope 7 of the X-ray tube 2 and X-ray housing 1. Namely, the internal pressure of the X-ray tube 2 stands at 3 to 5 kg/cm$^2$, a higher level than the external or atmospheric pressures. If, therefore, such high internal pressure of the X-ray tube 2 of as 3 to 5 kg/cm$^2$ can be reduced, then it will be possible to save the X-ray tube 2 from breakage. According to the pressure-reducing device of this invention, the shield 12 mounted on the bellows 11 is depressed downward by the above-mentioned high internal pressure of the X-ray tube 2 and pressed against the tip of the sharpened end 15 of the rod 16. Eventually, the sharpened end 15 of the rod 16 pierces the shield 12 to bore a through-hole therein. Then, gas confined envelope 7 of the X-ray tube 2 is released through the through-hole, until said internal pressure is reduced to the same level as the atmospheric pressure. Consequently, it is possible to eliminate the danger that the X-ray tube 2 will be broken by its high internal pressure as described above and the broken pieces of the X-ray tube 2 will be scattered.

Figure 4:
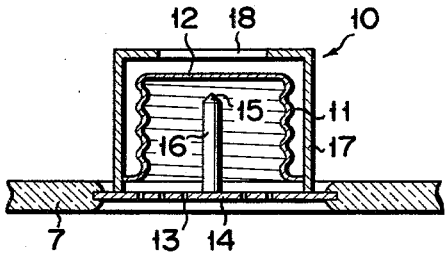
FIGS. 4 to 6 are sectional views of the modifications of the pressure-reducing device of FIG. 3.

There will now be described by reference to FIG. 4 a pressure-reducing device 10 according to another embodiment of this invention. This embodiment differs from that of FIG. 3 in that the shield 12 is not used; the upper portion of the pressure-reducing device 10 which is depressed by the high internal pressure of the X-ray tube 2 is integrally formed with the bellows 11; supporting frame 17 is provided to receive the bellows 11; and the upper wall of the supporting frame 17 is bored with an opening 18. The supporting frame 17 concurrently acts as a stopper for preventing the bellows 11 from being fully stretched. It is possible to provide this supporting frame 17 also for the bellows 11 of the pressure-reducing device shown in FIG. 3.

Figure 5:
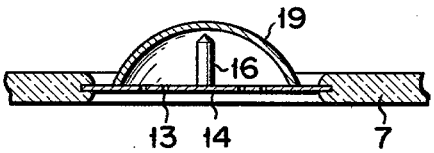

FIG. 5 illustrates a pressure-reducing device according to still another embodiment of this invention. With this embodiment, the pressure-reducing device comprises a thin arcuate flexible plate 19 which projects into the X-ray tube 2. This thin plate 19 is made of SUS 304 stainless steel or annealed oxygen-free copper, and has the same function as the shield 12 of FIG. 3.

Figure 6:
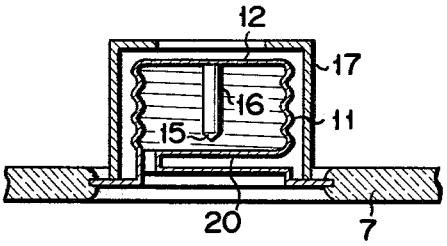

FIG. 6 indicates a pressure-reducing device 10 according to a further embodiment of this invention. With this embodiment, the flexible member is an integrally formed cylindrical bellows with an overall closed upper end and partly closed lower end. A rod 16 extends downward from the upper wall of the bellows 11 to pierce the flat lower plate 20 when the internal pressure of the X-ray tube 2 is extremely increased. The bellows 11 are enclosed in a supporting frame 17 as in the embodiment of FIG. 4.

Figure 7:
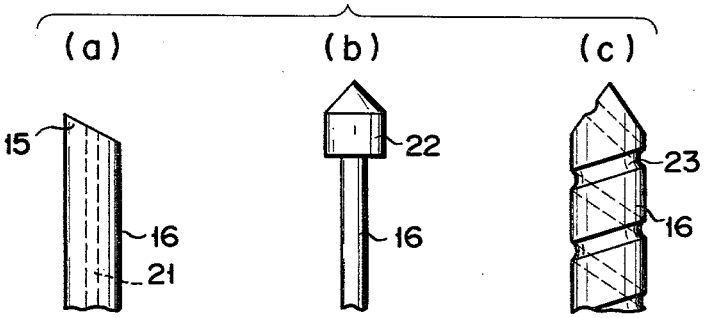
FIGS. 7(*a*), (*b*) and (*c*) are plan views of rods used with said modifications of FIGS. 4 to 6.

FIG. 7 shows the shapes of various rods 16 usable with the pressure-reducing device 10 of this invention. A rod 16 of FIG. 7(*a*) is bored with a passage 21 extending through the interior. A gas which might be carried into the X-ray tube 2 through pinholes occurring in the wall thereof is drawn off through said passage 21. A rod 16 of FIG. 7(*b*) has a large diameter section 22 formed at the outer end. When the rod 16 pierces the shield 12 or the upper wall of the bellows 11, the large diameter section 22 bores a wide penetrating hole. A gas brought into the X-ray tube 2 through said pinholes are released through a space lying between the larger diameter section 22 and smaller diameter section of the rod 16. A rod 16 of FIG. 7(*c*) has a continuous spiral groove 23 cut out in the peripheral wall. A gas entering the X-ray tube 2 through said pinholes are drawn off along said groove 23.

What is claimed is:

1. An X-ray tube comprising an evacuated envelope having an anode and cathode sealed therein, said envelope having an opening therein at a predetermined position in a wall portion of said envelope, a vertically movable flexible member extending from said wall portion at said opening and sealed to said wall portion, a rod having a sharp edge, said rod being supported at said wall portion and serving to pierce through said flexible member when the difference between the internal and external pressure of said envelope becomes greater than a predetermined value, and wherein the sharp edge of said rod is spaced from said flexible member by a predetermined distance.

2. The X-ray tube according to claim 1 wherein said envelope is elongated and said anode and cathode are sealed at opposite ends of said envelope and wherein said predetermined position for said opening is at a longitudinal center portion of said envelope or at a sealed end portion of said envelope facing said anode or cathode.

3. The X-ray tube according to claim 2 wherein said opening is covered with a metal plate having a plurality of through-holes therein and being fixed at the peripheral edge of said opening in said wall portion.

4. The X-ray tube according to claim 3, wherein the rod having a sharp end extends upward from the center of the metal plate.

5. The X-ray tube according to claim 4, wherein the flexible member is an integrally formed cylindrical bellows with closed upper end and lower edge thereof fixed to the metal plate.

6. The X-ray tube according to claim 5, wherein the flexible member is formed of a SUS 304 stainless steel.

7. The X-ray tube according to claim 5 which further comprises an outer frame for receiving the bellows.

8. The X-ray tube according to claim 5, wherein the upper part of the cylindrical bellows is formed of annealed oxygen-free copper differing from the other portion of the cylindrical bellows.

9. The X-ray tube according to claim 4, wherein the flexible member is fabricated in the arcuate form, and the lower edge thereof fixed to the metal plate.

10. The X-ray tube according to claim 9, wherein the flexible member is formed of material selected from the group consisting of SUS 304 stainless steel and annealed oxygen-free copper.

11. The X-ray tube according to claim 2, wherein the flexible member is an integrally formed cylindrical bellows with overall closed upper end and partly closed bottom, and the rod extends from the upper part of the bellows toward the bottom thereof.

12. The X-ray tube according to claim 1, wherein the rod is provided with additional gas-conducting means for drawing off a gas carried into the X-ray tube through pinholes occurring in the envelope thereof.

13. The X-ray tube according to claim 12, wherein the gas-conducting means is a passage bored lengthwise through the rod.

14. The X-ray tube according to claim 12, wherein the gas-conducting means is a spiral groove cut out in the peripheral wall of the rod.

15. The X-ray tube according to claim 12, wherein the gas-conducting means is a space lying between the larger diameter section and smaller diameter section of the rod.

* * * * *